US011819068B2

(12) United States Patent
Menshouse

(10) Patent No.: US 11,819,068 B2
(45) Date of Patent: Nov. 21, 2023

(54) BELT WITH LIGHTING ELEMENT

(71) Applicant: Jeffrey A. Menshouse, Orient, OH (US)

(72) Inventor: Jeffrey A. Menshouse, Orient, OH (US)

( * ) Notice: Subject to any disclaimer, the term of this patent is extended or adjusted under 35 U.S.C. 154(b) by 291 days.

(21) Appl. No.: 17/187,649

(22) Filed: Feb. 26, 2021

(65) Prior Publication Data

US 2021/0321684 A1 Oct. 21, 2021

Related U.S. Application Data

(60) Provisional application No. 62/981,630, filed on Feb. 26, 2020.

(51) Int. Cl.

| | |
|---|---|
| ***A41D 13/01*** | (2006.01) |
| ***F21V 21/08*** | (2006.01) |
| ***F21V 23/04*** | (2006.01) |
| ***F21V 33/00*** | (2006.01) |
| ***A41F 9/00*** | (2006.01) |
| ***A45F 3/14*** | (2006.01) |

(52) U.S. Cl.

CPC ..... *A41D 13/01* (2013.01); *F21V 21/0816* (2013.01); *F21V 23/0414* (2013.01); *F21V 33/0008* (2013.01); *A41D 2200/10* (2013.01); *A41F 9/002* (2013.01); *A45F 2003/144* (2013.01)

(58) Field of Classification Search

CPC ..... F21V 33/0008; F21V 23/0414; F21V 21/0816; A41F 9/002; A45F 2003/144

See application file for complete search history.

(56) References Cited

U.S. PATENT DOCUMENTS 3,641,333 A * 2/1972 Gendron ..... A41F 9/002 362/108

7,448,766 B1 * 11/2008 Lee ..... A41F 9/002 362/108

* cited by examiner

*Primary Examiner* — Thomas M Sember

(74) *Attorney, Agent, or Firm* — MIP Legal, Ltd.; Bryce D. Miracle, Esq.

(57) ABSTRACT

A duty belt for providing visibility and awareness of the user wearing the belt is disclosed. The belt is worn about the waist and generally provides a lighting element which illuminates in order to improve the visibility and awareness of a person viewed from a distance. Further, the duty belt is functionally and ergonomically designed to easily attach existing duty gear including pepper spray, firearms, flashlights, etc. without interfering or snagging with the lighting element.

15 Claims, 14 Drawing Sheets

BELT WITH LIGHTING ELEMENT

CROSS-REFERENCE TO RELATED APPLICATION

This application is based upon and claims the priority filing date of the previously filed, U.S. provisional patent application entitled "DUTY BELT WITH LIGHTING ELEMENT" filed Feb. 26, 2020, having App. No. 62/981,630, the entire disclosure of which is hereby incorporated herein by reference.

FIELD OF THE INVENTION

The present invention relates to a belt, particularly to a belt providing a lighting element to help improve the safety, awareness, and visibility of the person wearing the belt.

BACKGROUND

A police duty belt, sometimes referred to as a gun belt, duty rig, and/or kit belt, is a belt used by police and security officers to carry equipment in a series of pouches attached to the belt, in a readily-accessible manner, while leaving the hands free to interact. This belt can carry any number of useful items and gear, for example, handcuffs, flashlights, pepper spray, firearms, etc.

Duty belts wrap around the officer's waist and fasten with a buckle at the front. Most duty belts have a width of 2¼ inches and are either made of ballistic nylon or leather. Nylon duty gear is generally less expensive, lighter, and easier to maintain than leather gear of comparable quality.

Law enforcement and other designated personnel, particularly those engaged with directing traffic, typically utilize safety equipment such as traffic cones and warning signs, signal flares, signal flags, hand signs, and signal batons to direct traffic and mitigate harm to themselves and surrounding people. Often, personnel wear safety clothing and/or gear such as reflective vests, boots, pants, and helmets to maximize visibility to drivers. However, even with the implementation of existing safety equipment, often vehicle drivers are distracted and do not see the law enforcement and other workers causing severe bodily injury or even death.

For the foregoing reasons, there is a need for improved safety equipment that is hands-free, integrates with existing equipment, and visually alerts vehicle traffic of the presence of law enforcement or other designated personnel.

SUMMARY

The present application relates to a unique duty belt for providing visibility and awareness of the user wearing the belt. The belt is worn about the waist and generally provides a lighting element that illuminates to improve the visibility and awareness of a person viewed from a distance. Further, the duty belt is functionally and ergonomically designed to easily attach existing duty gear including pepper spray, firearms, flashlights, etc. without interfering or snagging with the lighting element. Ideally, the duty belt is outfitted to be effectively worn by law enforcement, roadside assistance personnel, roadside workers, and/or any person wanting to be clearly seen, particularly as it relates to passing traffic.

In a version of the application, the duty belt may generally comprise: a belt portion configured to extend about the waist of the user between a first end and a second end, the belt portion having a top perimeter, bottom perimeter, interior side and an exterior side; a buckle assembly for selectively connecting the first end and the second end of the belt; a lighting element operably positioned to emit light along the length of the exterior side of the belt portion between the first end and the second end; a light controller assembly for selectively operating the lighting element, the light controller assembly comprising: a power supply for providing electric power; and a power switch;

In a version of the application, the exterior side of the belt portion comprises an upper strip of material extending the length of the top perimeter and a lower strip of material extending along the bottom perimeter, the upper strip and the lower strip are positioned to form a channel which extends therebetween along the length of the belt portion; wherein the lighting element is operably positioned between the upper strip and the lower strip within the channel.

Further, the lighting element comprises an outermost point, wherein the outermost point is positioned at or below the exterior surface of the exterior side of both the upper strip and the lower strip, thereby providing an unhindered exterior side accessible for attachment of the user's gear. The interior side of the belt portion comprises a rear strip of material extending between the top perimeter and the lower perimeter and along the length of the belt portion.

In a detailed version of the application, the belt portion further comprises a light transparent layer having a top perimeter and a bottom perimeter, wherein the top perimeter is sandwiched between the upper strip and the rear strip of material and the bottom perimeter is sandwiched between the lower strip and the rear strip of material, wherein a portion of the light transparent layer extends across the channel and over the lighting element, thereby providing a protective cover over the lighting element.

In certain versions of the application, the outermost point of the light transparent layer is positioned at or below the exterior surface of the exterior side of both the upper strip and the lower strip, thereby providing an unhindered exterior side accessible for attachment of the user's gear.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Referring now to the figures wherein the showings are for purposes of illustrating a preferred version of the invention only and not for purposes of limiting the same, the present invention is a unique duty belt for providing visibility and awareness of the user wearing the belt. The duty belt generally provides a lighting element that illuminates to provide visibility from a distance and to bring awareness of the presence of a person. Further the duty belt, is functionally and ergonomically designed to easily attach existing duty gear including pepper spray, firearms, flashlights, etc. without interfering or snagging with the lighting element.

In the following description, for purposes of explanation and not limitation, specific details are set forth such as particular architectures, interfaces, techniques, etc. to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense, but is made merely for the purpose of illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

Figure 1:
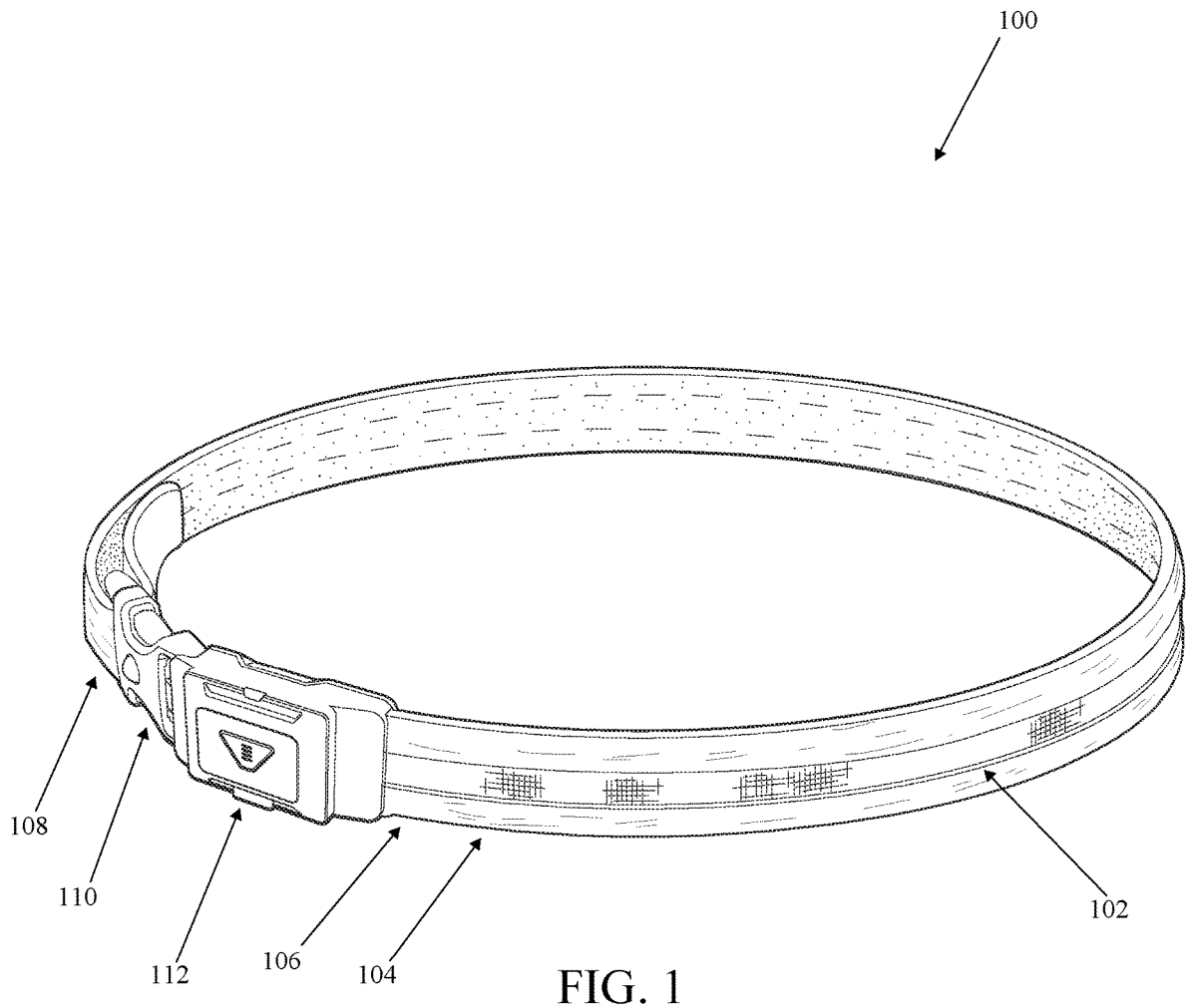
FIG. 1 is a front perspective view of a version of the belt.
Figure 2:
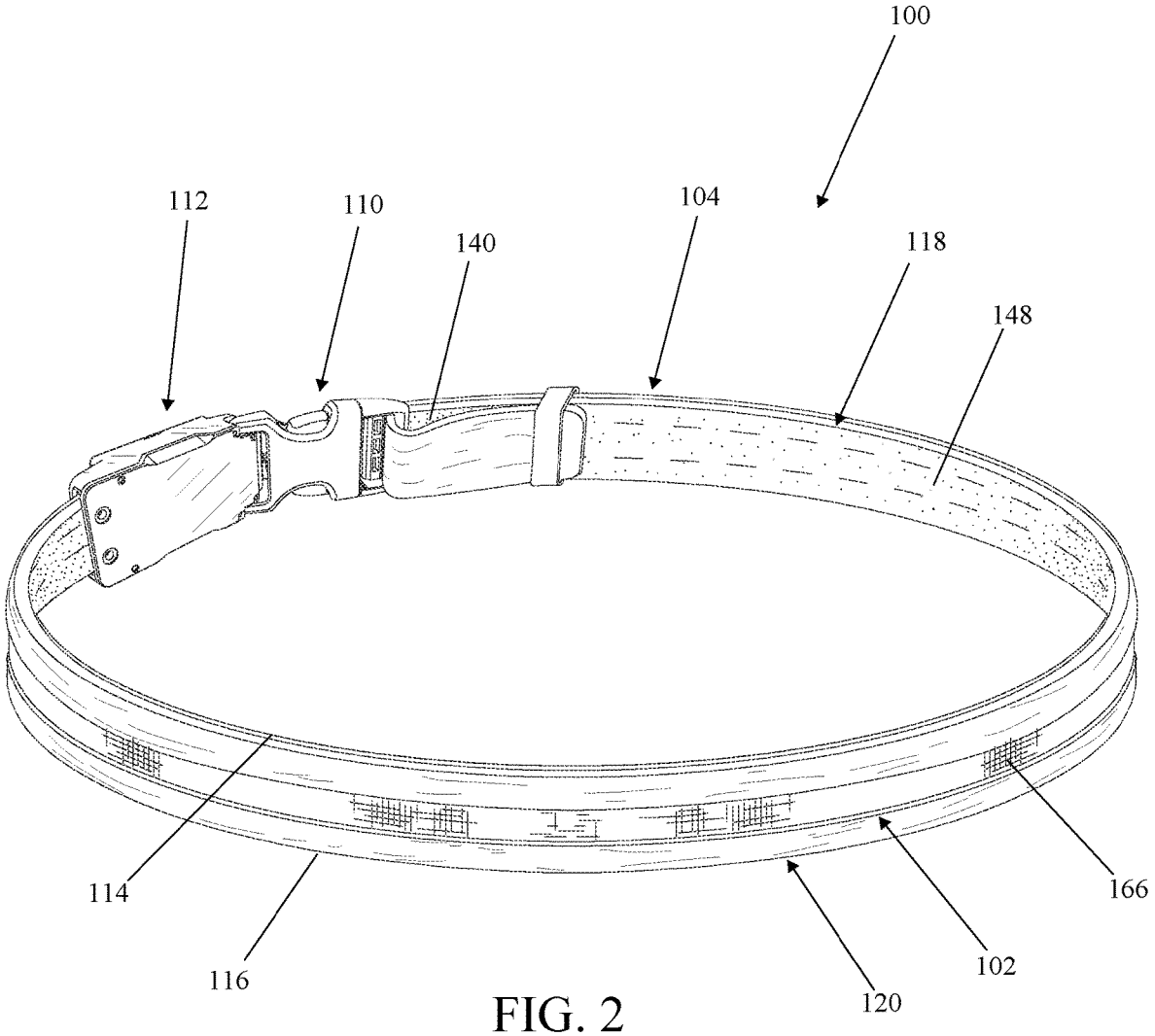
FIG. 2 is a rear perspective view of the version shown in FIG. 1.
Figure 15:
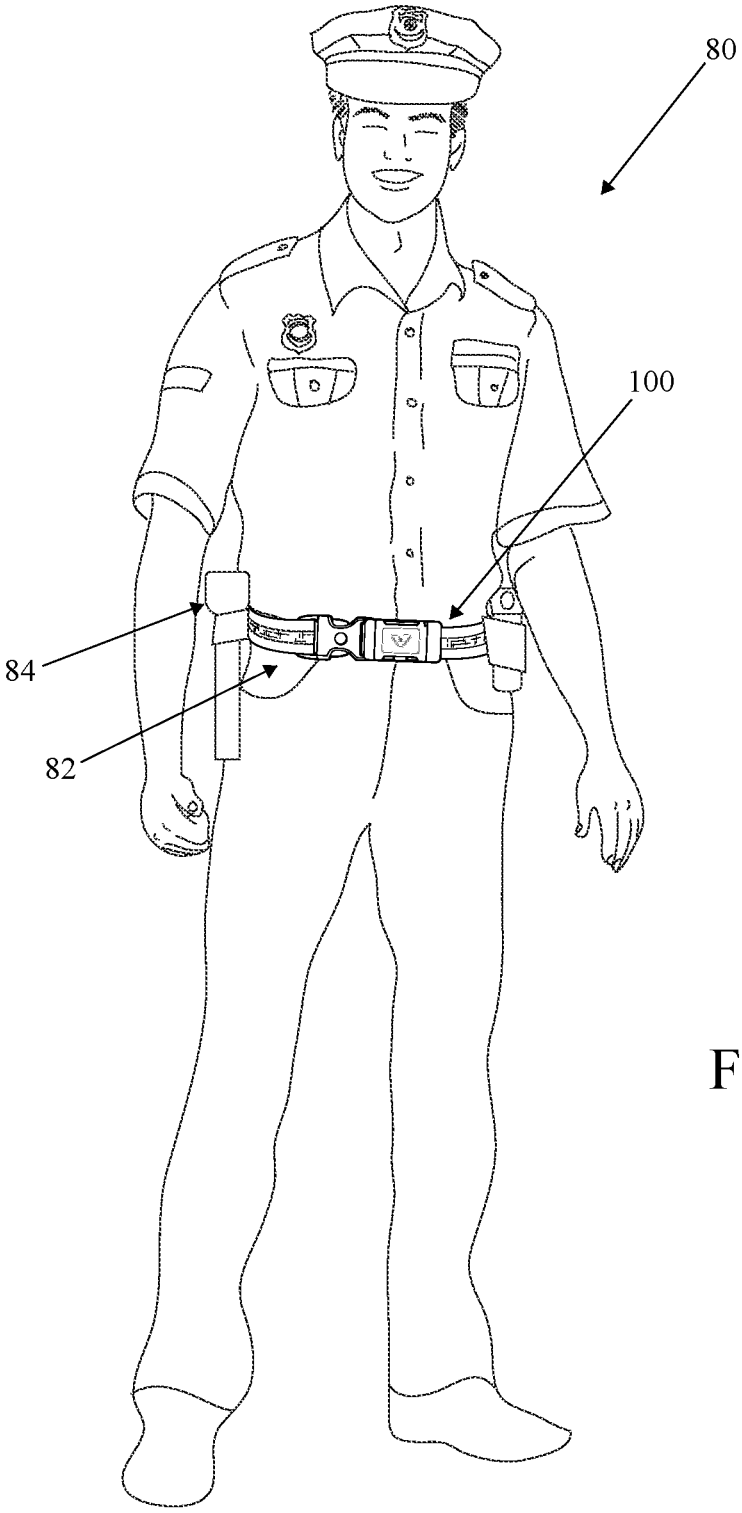
FIG. 15 is an illustrative view of a version of the belt as worn by a person.
Figure 16:
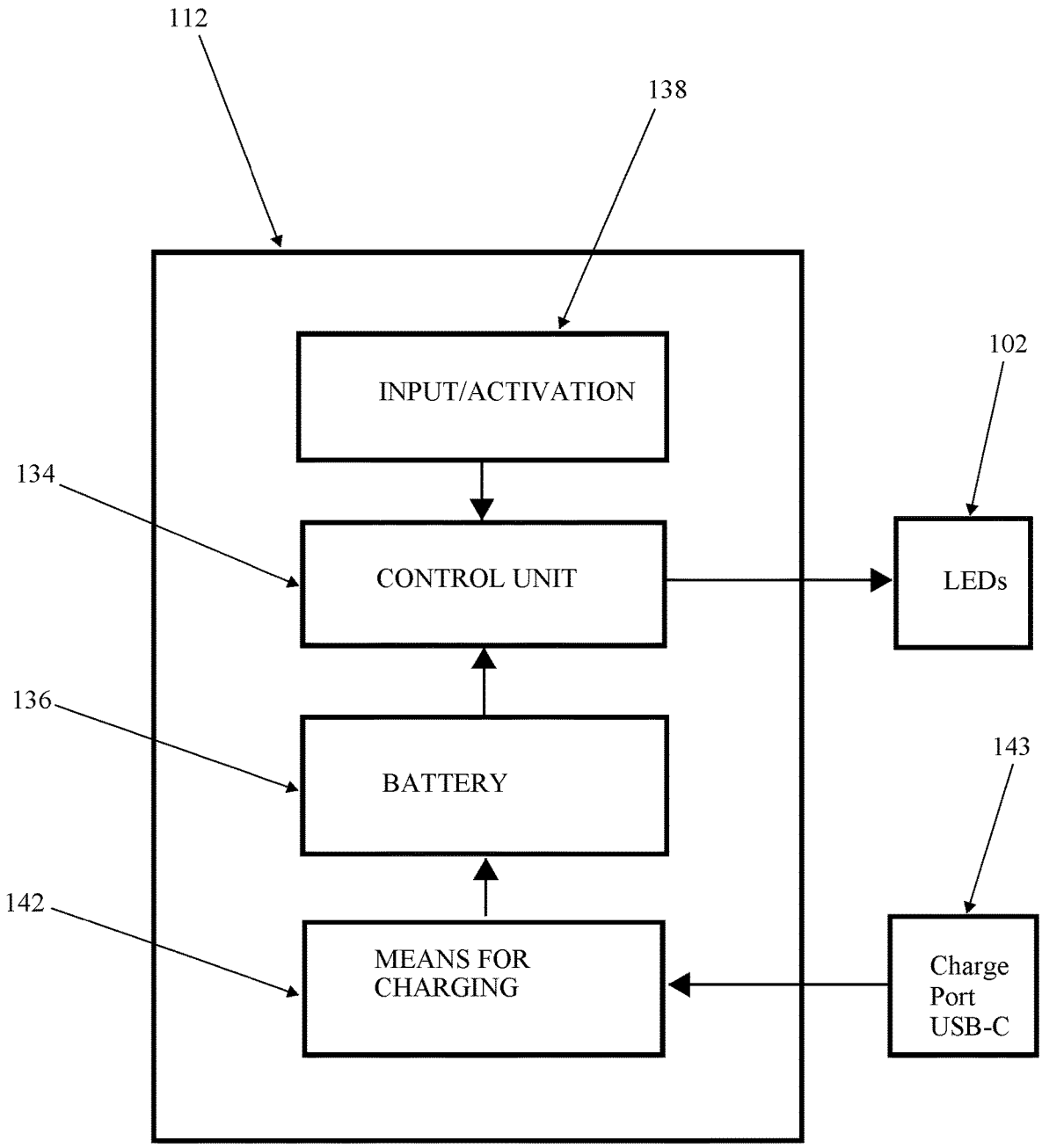
FIG. 16 is a box diagram illustrating the components of the controller assembly.

Initially with reference to FIG. 1-FIG. 7C, a description of a version of the invention will be provided. In particular, FIG. 1 is a front perspective view showing a version of the duty belt 100. In the version, the duty belt 100 includes a lighting element 102 which generally extends the circumference of the belt 100. Thus, while in use, the lighting element 102 uniquely illuminates the waistline of the person 80 wearing the belt 100 (See FIG. 15) which dramatically increases the visibility and awareness of the presence of a person. Ideally, the duty belt 100 is outfitted to be effectively worn by law enforcement, roadside assistance personnel, roadside workers, and/or any person wanting to be clearly seen, particularly as it relates to passing traffic.

In certain versions of the application and as shown in FIG. 1-FIG. 7C, the duty belt 100 generally comprises a belt portion 104 which extends between a first end 106 and a second end 108, a buckle assembly 110 for connecting the first end 106 with the second end 108, a lighting element 102 which generally extends the length of the belt portion 104, and a controller assembly 112 for operating the lighting element 102.

The belt portion 104 is configured to extend about the waist of the user between the first end 106 and the second end 108. Generally, the belt portion 104 has a top perimeter 114, a bottom perimeter 116, an interior side 118 and an exterior side 120. In the version, the belt portion 104 is generally rectangular in shape and is ideally manufactured of a high-grade, heavy-duty nylon.

Figure 10:
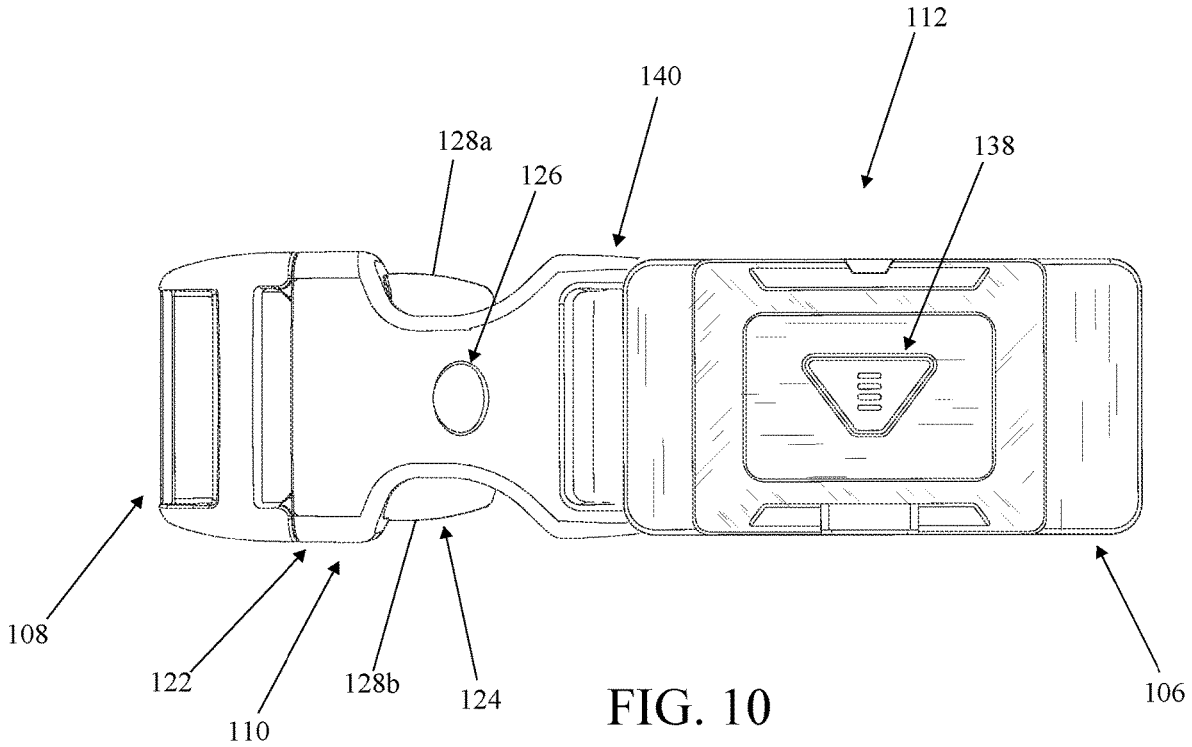
FIG. 10 is a front elevation view of the buckle assembly of the version shown in FIG. 1.
Figure 11:
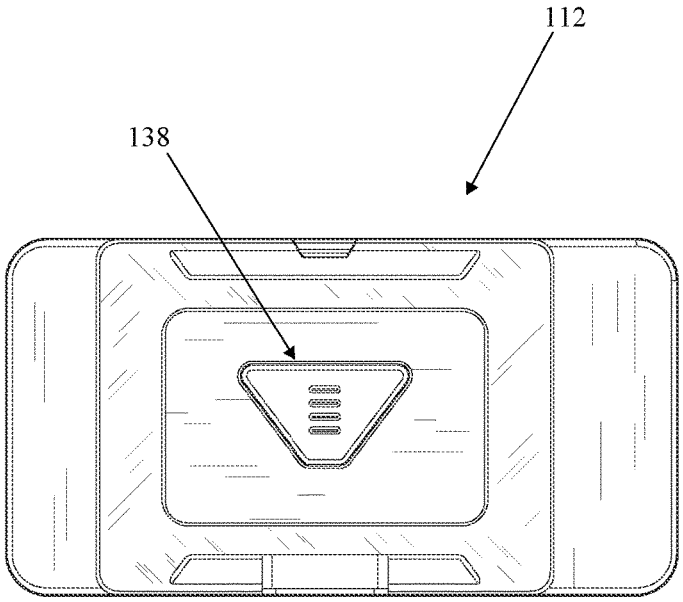
FIG. 11 is a front elevation view of the controller assembly apart from the buckle assembly shown in FIG. 10.
Figure 12:
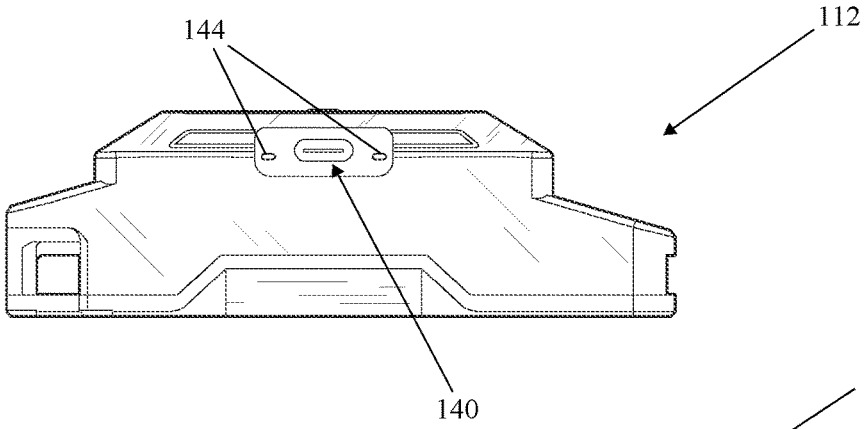
FIG. 12 is a bottom plan view of the controller assembly of the version shown in FIG. 11.
Figure 13:
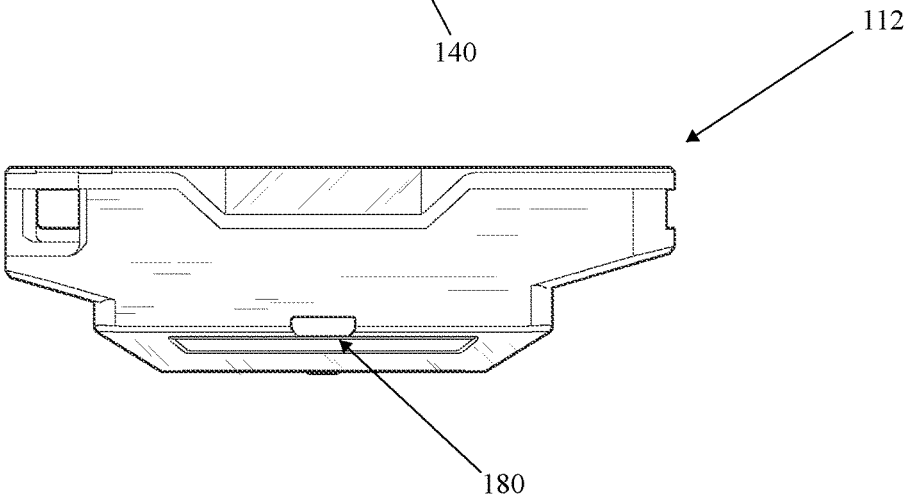
FIG. 13 is a top plan view of the controller assembly of the version shown in FIG. 11.
Figure 14:
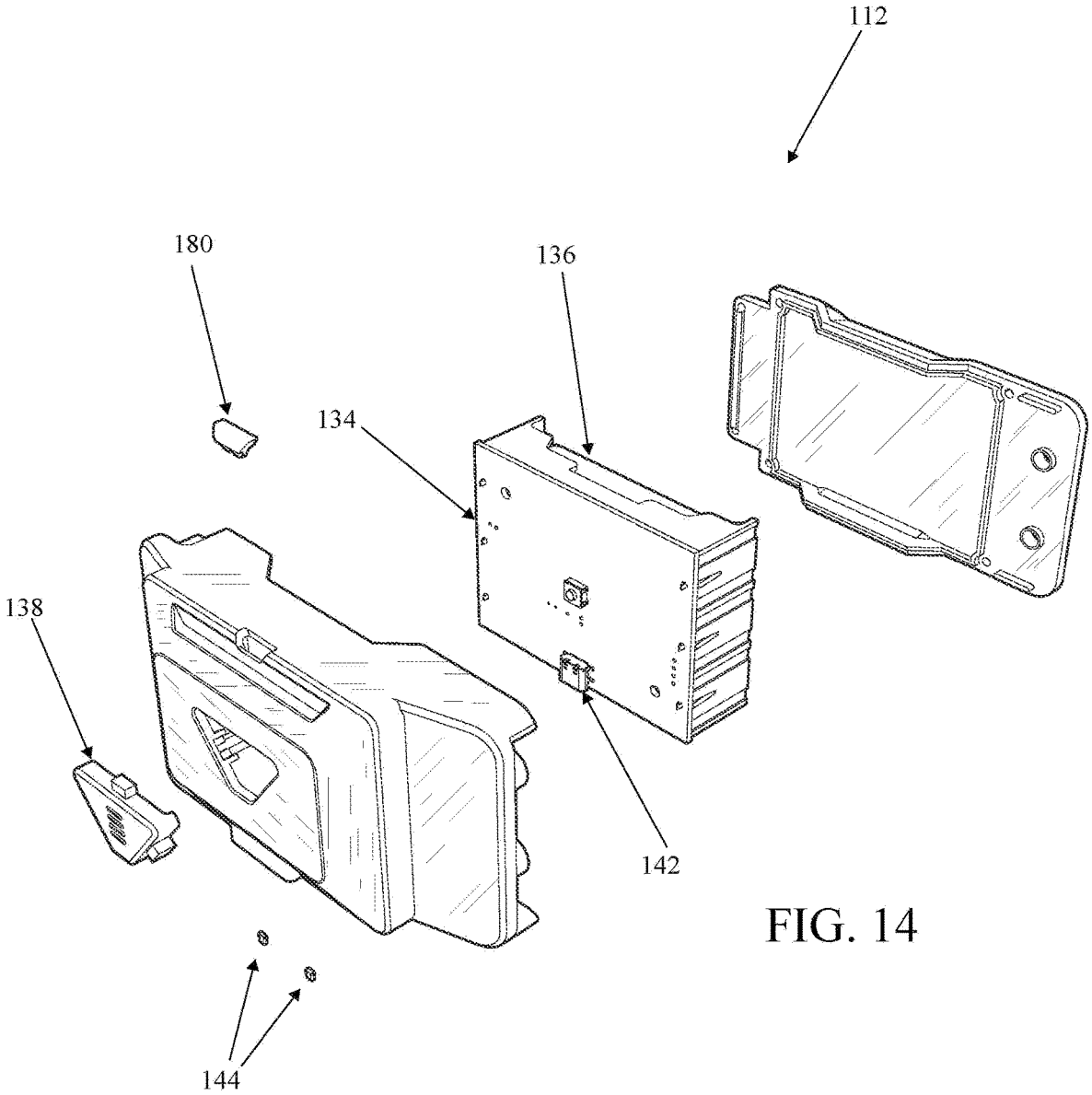
FIG. 14 is an exploded view of the controller assembly of the version shown in FIG. 11.

With reference to FIG. 1 and FIG. 10, the buckle assembly 110 includes a female buckle end 122 positioned at the first end 106 of the belt portion 104 and a male buckle end 124 positioned at the second end 108 of the belt portion 104. Preferably, as illustrated in the version, the female buckle end 122 and the male buckle end 124 operably connect together via a side release configuration with a snap fit button 126 which securely fastens each of the first end 106 and the second end 108 together. In order to release the male buckle end 124 from the female buckle end 122, the opposing side prongs 128*a*, 128*b* of the male buckle end 124 are squeezed together and the snap fit button 126 is depressed simultaneously, thereby releasing the male buckle end 124 from the female buckle end 122. Other belt buckle designs can certainly be utilized.

Figure 3:
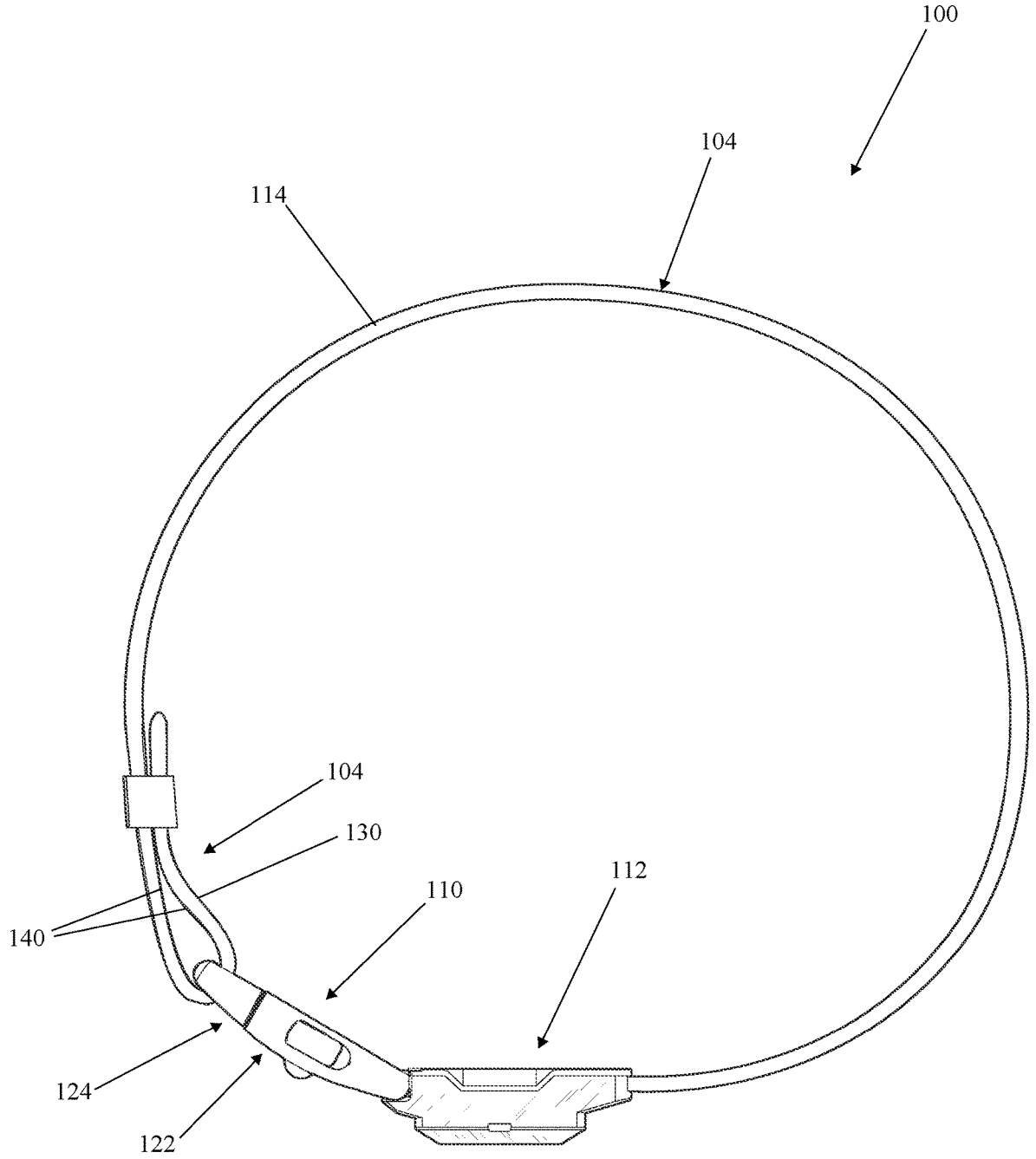
FIG. 3 is a top plan view of the version shown in FIG. 1.
Figure 4:
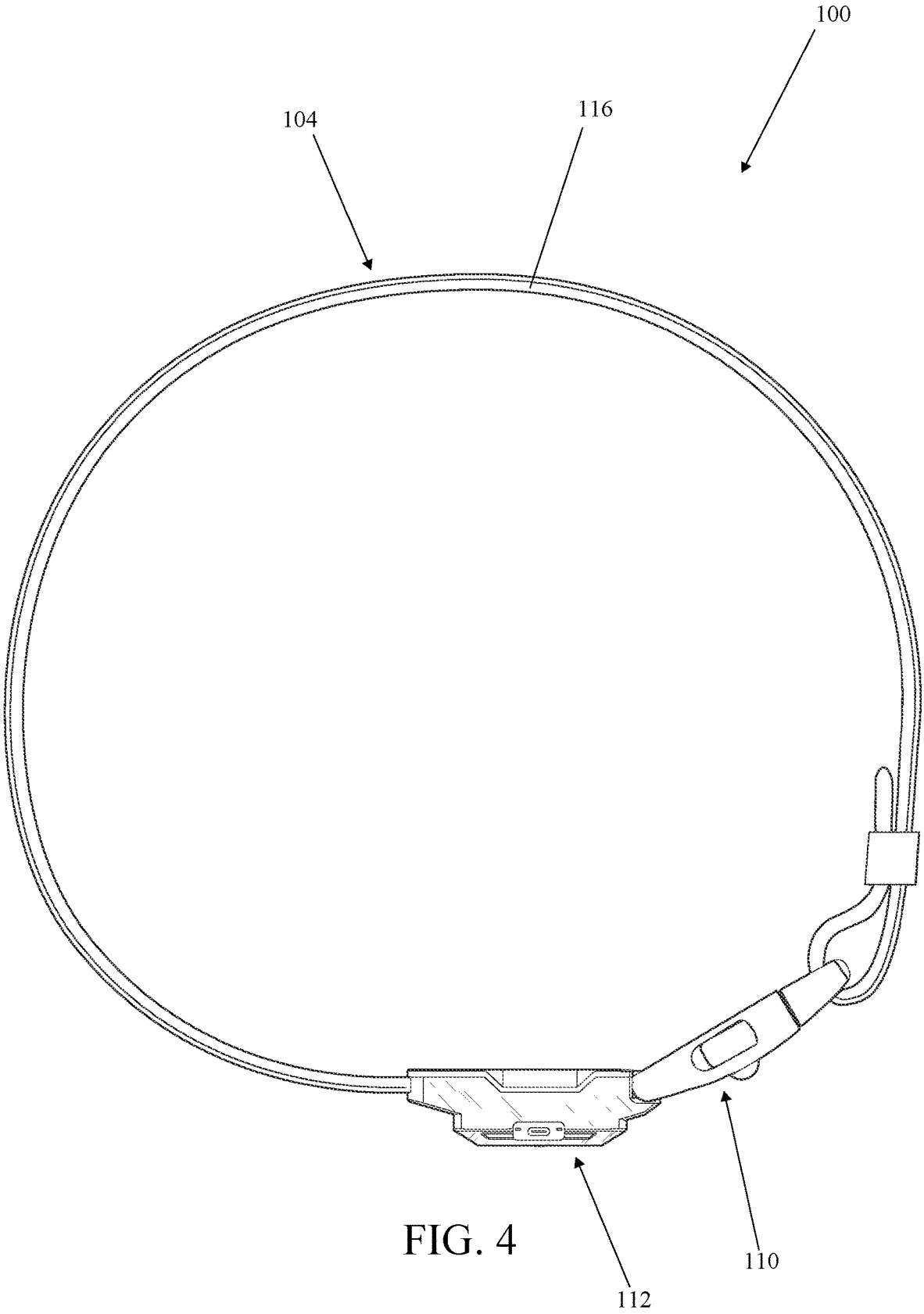
FIG. 4 is a bottom plan view of the version shown in FIG. 1.
Figure 5:
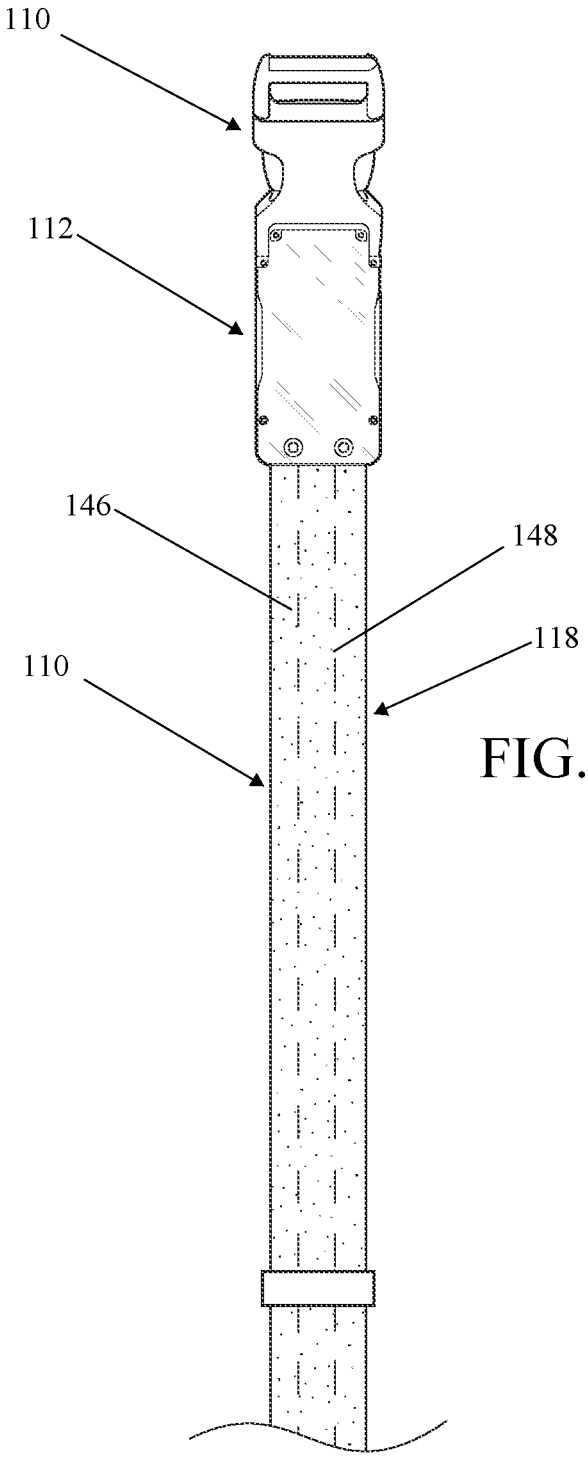
FIG. 5 is a partial rear elevation view of the version shown in FIG. 1.
Figure 6:
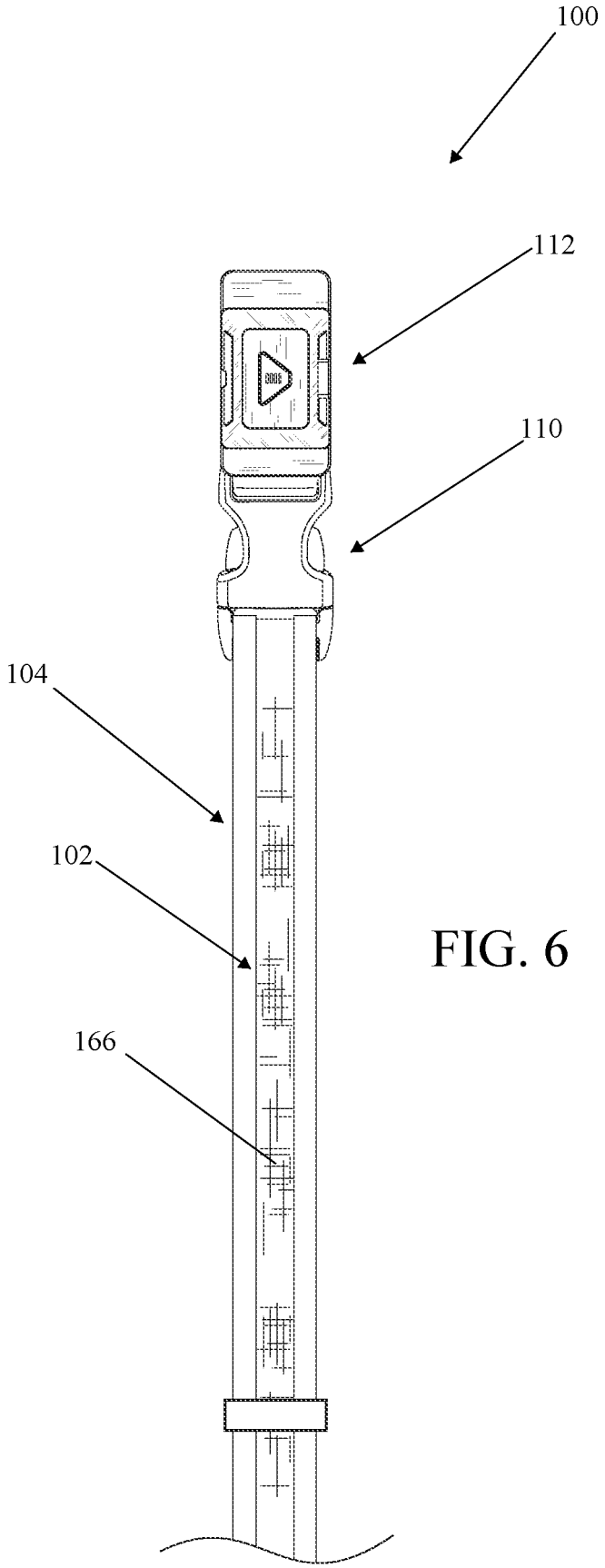
FIG. 6 is a partial front elevation view of the version shown in FIG. 1.

The belt portion 104 and buckle assembly 110 are adapted to encapsulate and wrap around the waist 82 of the personnel 80 wearing the belt 100 and may optionally be length adjustable to accommodate various waist dimensions. For example, FIG. 3 shows a top plan view illustrating how the belt portion 104 can be configured to selectively loop through either the female buckle end 122 or male buckle end 124 and back upon itself, typically utilizing hook and loop material 140 to secure the loose end 130. Thus, providing the user the ability to lengthen or shorten the belt portion 104 based on their particular waist circumference. Preferably, belt keepers may be utilized in conjunction with the belt 100 to ensure that the belt 100 stays in place, particularly while personnel is removing an item or gear 84 from the belt 100 or engaging in an altercation with a suspect.

In a version as illustrated by FIGS. 7A-7C and FIG. 9, the lighting element 102 is a plurality of light-emitting diodes ("LED lights") 130. Preferably, a linear LED strip 132 or an elongated strip of sequenced LED lights 130 is positioned along the length of the belt portion 104 approximately at a midpoint M between the top perimeter 114 and the bottom perimeter 116 on the exterior side 120. When lit, the lighting element 102 emits light in the form of a ring around the waist 82 of the officer 80, thus significantly improving visibility and safety thereof (See FIG. 15). In other versions, the light element 102 may comprise one or more traditional lights in various configurations. For example, lighting elements 102 could be positioned along the top perimeter 114 and/or the bottom perimeter 116 or in a cluster or other pattern configuration.

As best shown in FIG. 10-FIG. 14, the light controller assembly 112 is configured to allow the user operation of the lighting element 102. Generally, the light controller assembly 112 may include a control unit 134 for controlling the activation of the lighting element 102, an onboard power supply 136 or battery for providing electric power to the lighting element 102 and/or control unit 134, and a power/activation/input switch 138 which is operably configured to allow the user to activate the lighting element 102 by communicating with the control unit 124 and provide the ability to select various lighting options.

Figure 7A:
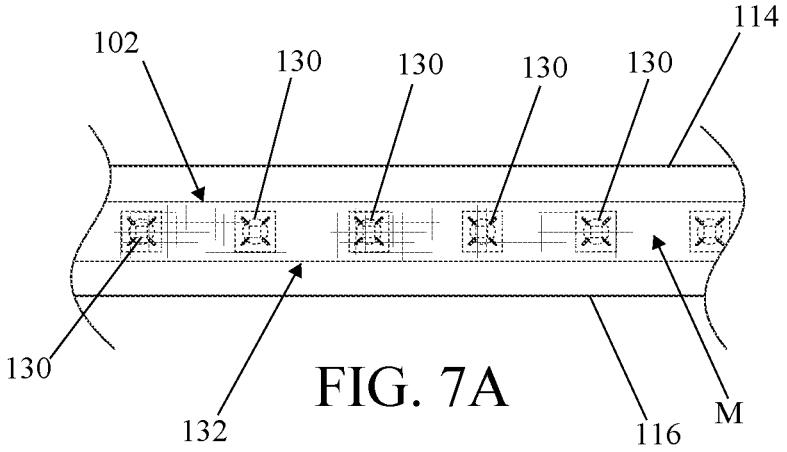
FIG. 7A is a partial up-close front elevation view showing the lighting element while providing a low intensity light.
Figure 7B:
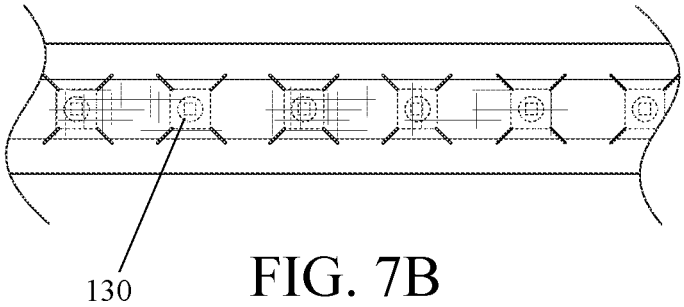
FIG. 7B is a partial up-close front elevation view showing the lighting element while providing a medium intensity light.
Figure 7C:
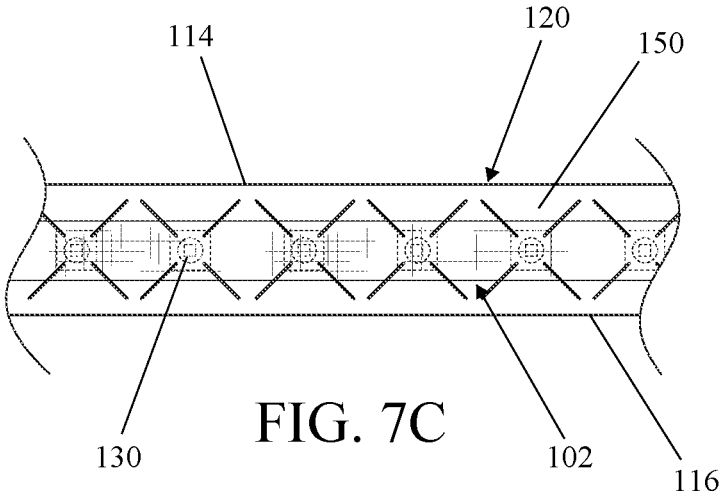
FIG. 7C is a partial up-close front elevation view showing the lighting element while providing a high intensity light.

With reference to FIGS. 7A-7C and FIG. 16, the control assembly 112 via the control unit 134 may generally provide the user the ability to adjust the intensity of the light emitted from the lighting element 102 from a dim (low) setting to a bright (high) setting depending on the desired light output. For example, FIG. 7A illustrates the lighting element 102 while providing either a solid light emission (no flashes) or a light flash sequence that has a low intensity for the desired effect of producing a lower level of visibility. FIG. 7B illustrates either a solid light emission or a light flash sequence that has a medium intensity. FIG. 7C illustrates either a solid light emission or a light flash sequence that has a high intensity for producing a high level of visibility. Preferably, the control unit 134 is a micro LED light controller that varies the output voltage of the power supply 136 in order to produce a spectrum of light intensities. Ideally, the control unit 134 output voltage is preferably 3-8 volts sufficient to power a 12 volt LED light strip, providing a spectrum of light intensities.

Aside from providing the ability to adjust the light intensity, the control unit 134 may be configured to provide the user the ability to select optional light-emitting flash sequences/patterns. As an example, the control unit 134 can be configured or programmed to instruct the lighting element 102 to emit a solid continuous light or follow a predetermined flash pattern or sequence based on the timed activation of one or more of the LED lights. For example, a flash pattern sequence may implement the following cycle: sequence 1: control unit 134 activates lighting element 102 for a period of 1.5 seconds, the control unit 134 deactivates lighting element 102 for a period of 2 seconds; sequence 2: control unit 134 activates lighting element 102 for a period of 1.5 seconds, control unit 134 deactivates lighting element 102 for a period of 2 second which completes the cycle. The cycles may continue C1, C2 . . . Cn, where n equals the number of cycles, until the user either activates another light emitting flash pattern sequence or turns off the control unit 134 via the activation switch 138.

Preferably, the user can depress the activation switch 138 for a predetermined period of time to adjust the intensity of the light. Other versions of the application may provide one or more switches or activation buttons to carry out the selection light flash patterns/intensity options. The power/activation switch 138 may serve more than one purpose such as both an on/off switch and as a button to adjust light intensity or lighting flash sequences.

Preferably, the power supply 136 or battery is positioned within the light controller assembly 112 adjacent to the control unit 134 to provide a compact profile. Preferably, the power supply 136 is a lithium battery that provides at least 750 mAh which shall be sufficient to supply several hours of battery life for a 12 volt linear LED light strip. In other versions of the application, the power supply or battery 136 may be positioned exterior of the duty belt 100. For example, the battery could be detached from the duty belt 100 and positioned in a pocket of the personnel 80 or attached interior of the belt portion 104.

Preferably, the controller assembly 112 includes a means for charging 142 the battery 136. In the illustrated version (FIG. 14) a USB-C female port 143 is provided which is adapted to receive power from a standard USB-C cable. Further, light indicators 144 may be utilized to indicate that the controller assembly 112 and power supply 136 are receiving a charge from the USB-C cable or other type. In a version, there is a light 180 which turns on to indicate that the battery 136 is low on power.

In certain versions, the buckle assembly 110 and the controller assembly 112 may be integrally combined. In the version as illustrated in FIG. 10, the buckle assembly 110 is flexibly attached to the controller assembly 112 via a pivoting joint 140. Preferably, the entirety of the interior surface 146 of the interior side 118 of the belt portion 104 comprises hook and/or loop type material 148, a preferably loop material to provide an attachment surface for the user's gear and other items having reciprocal hook material thereon or vice versa.

Figure 8:
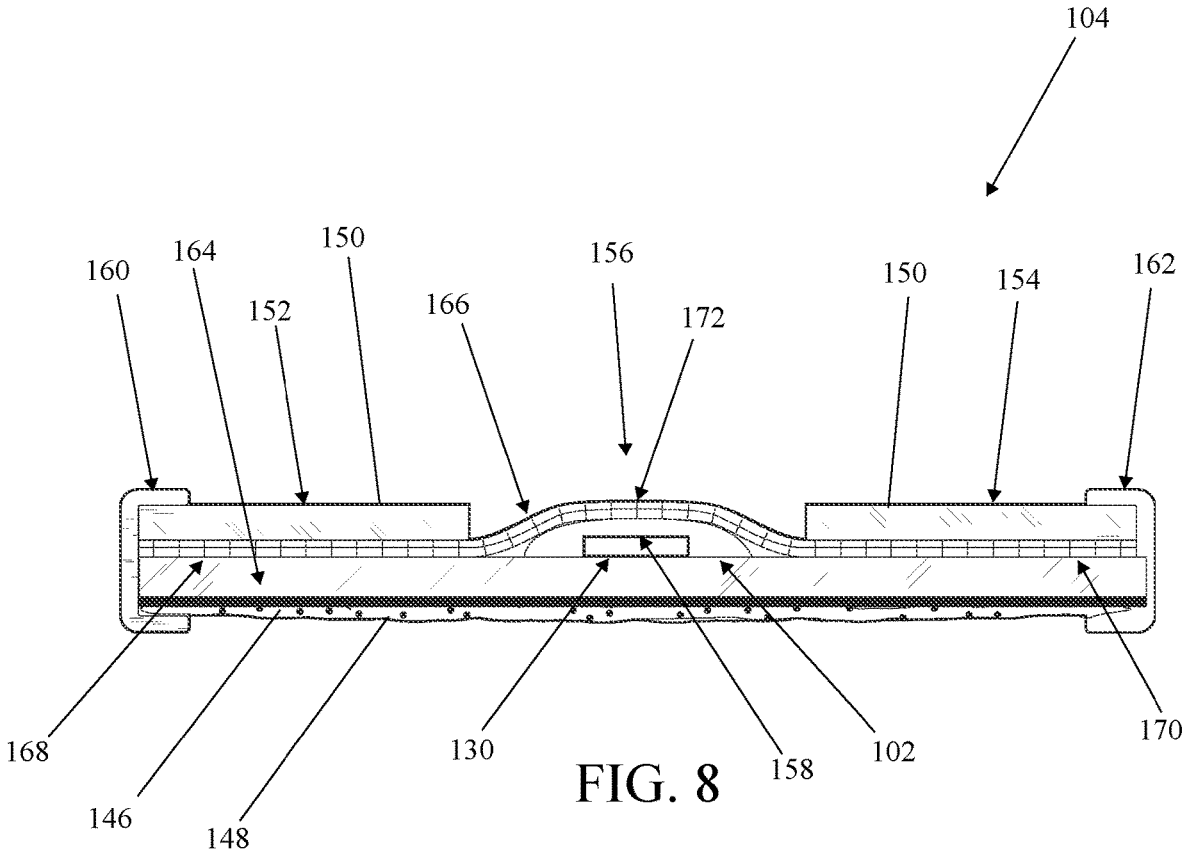
FIG. 8 is a cross-sectional view of the belt portion of the version shown in FIG. 1.
Figure 9:
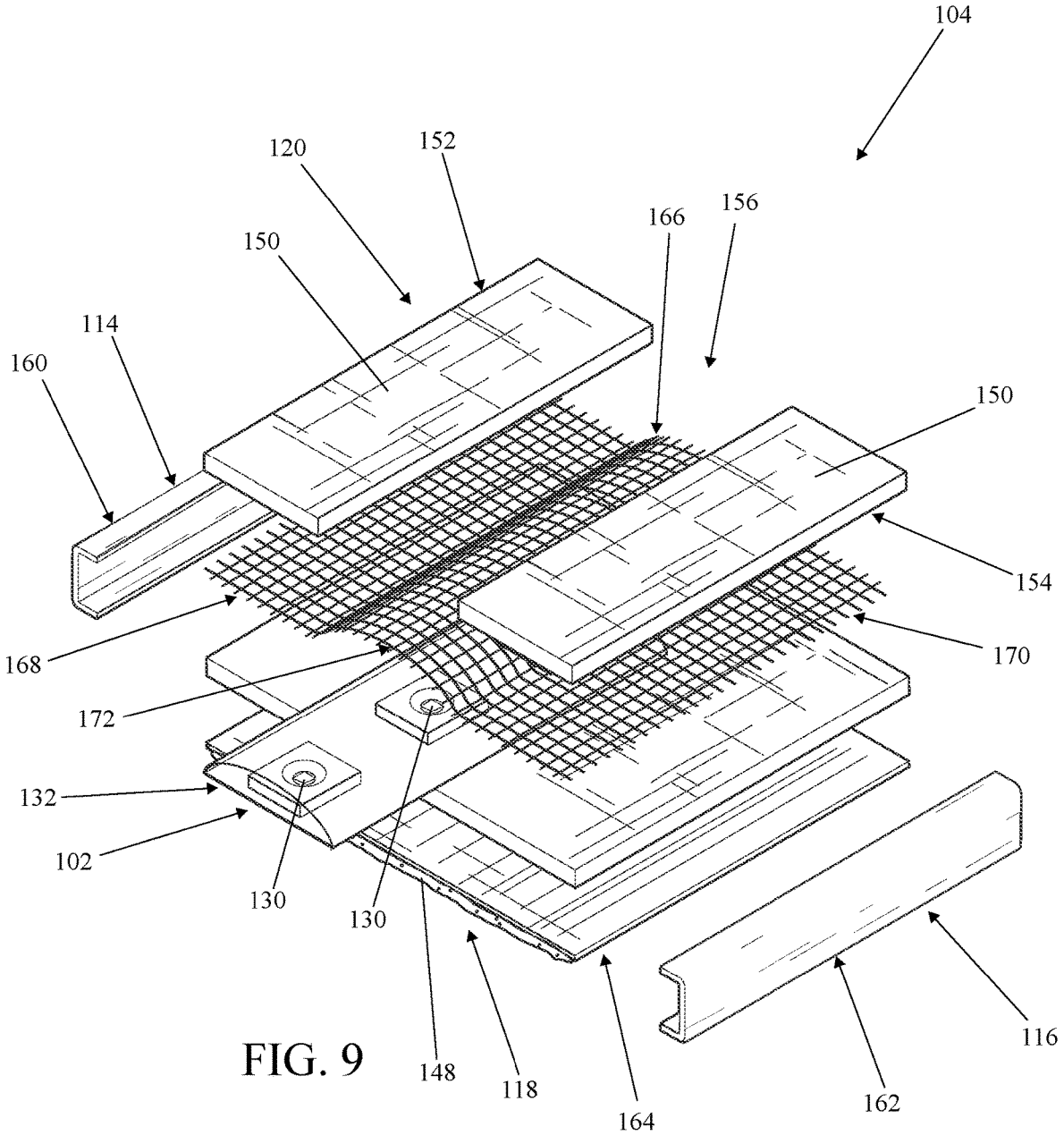
FIG. 9 is an exploded view of a length of the belt portion of the version shown in FIG. 1 illustrating the unique layers thereof.

With specific reference to FIG. 8 and FIG. 9, the lighting element 102 can be attached into or embedded within the surface of the exterior side 120 of the belt portion 104 in order to form a mostly continuous flush exterior surface 150. This type of configuration would provide an unhindered exterior side 120 exterior surface 150 which is ideal when attaching the user's gear 84 and other items, such as a firearm, flashlight, pepper spray, hand cuffs, etc. (See FIG. 15). Positioning the lighting element 102 below the exterior surface 150 of the exterior side 120 allows the duty belt 100 to function exactly as a traditional duty belt would. Put simply, the gear 84 and other items placed on the duty belt 100 will not snag on the lighting element 102 nor do any of the controls of the lighting element 102 interfere with the gear 84.

In the version, the exterior side 120 of the belt portion 104 comprises an upper strip of material 152 extending the length of the top perimeter 114 and a lower strip of material 154 extending along the bottom perimeter 116, the upper strip 152 and the lower strip 154 are positioned to form a channel 156 which extends therebetween along the length of the belt portion 104. The lighting element 102 is operably positioned between the upper strip 152 and the lower strip 154 within the channel 156. Preferably, the upper strip of material 152 and the lower strip of material 154 are rectangular and planar in nature providing a flat exterior surface and are flexible. Ideally, the strips 152, 154 are manufactured of a woven nylon; however, can be made of other materials such as metal, plastics, and composites.

Further, in the version, the lighting element 102 comprises an outermost point 158 as best shown in FIG. 8. Generally, the outer most point 158 is positioned at or below the exterior surface 150 of the exterior side 120 of both the upper strip of material 152 and the lower strip of material, thereby providing an unhindered exterior side 120 accessible for attachment of the user's gear 84.

In the depicted version, the belt portion 104 may further include a top perimeter cap 160 and a lower perimeter cap 162, each of the top perimeter cap 160 and the lower perimeter cap 162 extends the length of the belt portion 104 and is configured to clamp the layers at their respective perimeters 114, 116 to maintain structural integrity of the belt portion (See FIG. 8).

In the version, the interior side 118 of the belt portion 104 comprises a rear strip of material 164 extending between the top perimeter 114 and the lower perimeter 116 and along the length of the belt portion 104 essentially forming a rear wall. Preferably, the rear strip of material 164 forming a rear wall is made of a woven nylon material. Preferably, the rear strip of material 164 is rectangular in nature and provides a planar interior surface 146.

Preferably, the belt portion 104 further comprises a light transparent layer 166 having a top perimeter 168 and a bottom perimeter 170, wherein the top perimeter 168 is sandwiched between the upper strip of material 152 and the rear strip of material 164 and the bottom perimeter 170 is sandwiched between the lower strip of material 154 and the rear strip of material 164. As illustrated clearly in FIG. 8, a portion of the light transparent layer 166 extends across the channel 156 and over the lighting element 102, thereby providing a protective cover over the lighting element 102 while providing an overall continuous exterior side 120 exterior surface 150.

In certain embodiments, it is preferable that the outermost point 172 of the light transparent layer 166 is positioned at or below the exterior surface 150 of the exterior side 120 of both the upper strip of material 152 and the lower strip of material 154, thereby providing an unhindered exterior side 120 accessible for attachment of the user's gear 84. Preferably, the light transparent layer 166 is a least partially manufactured of a mesh material, ideally either an extruded plastic mesh or a woven plastic mesh; however, other materials may be utilized such as a clear plastic or other transparent material.

The duty belt 100 can be made in any manner and of any material chosen with sound engineering judgment. Preferably, materials will be strong, lightweight, long lasting, economic, and ergonomic. In certain versions, the duty belt can incorporate materials such as metals, leather, plastics, composites, and synthetics.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A duty belt for providing visibility and awareness of a user wearing the belt, the belt comprising:

a belt portion configured to extend between a first end and a second end, the belt portion having a top perimeter, bottom perimeter, interior side, and an exterior side;

a buckle assembly for selectively connecting the first end and the second end of the belt;

a lighting element operably positioned to emit light along a length of the exterior side of the belt portion between the first end and the second end;

a light controller assembly for selectively operating the lighting element, the light controller assembly comprising:

a power supply for providing electric power; and a power switch;

wherein the exterior side of the belt portion comprises an upper strip of material extending a length of the top perimeter and a lower strip of material extending along a length of the bottom perimeter, the upper strip and the lower strip are positioned to form a channel which extends therebetween along the length of the belt portion;

wherein the lighting element is operably positioned between the upper strip and the lower strip within the channel.

2. The duty belt of claim 1, wherein the exterior side further comprises an exterior surface, wherein the lighting element comprises an outermost point, wherein the outermost point is positioned at or below the exterior surface.

3. The duty belt of claim 2, wherein the interior side of the belt portion comprises a rear strip of material extending between the top perimeter and the lower perimeter and along the length of the belt portion.

4. The duty belt of claim 3, wherein the belt portion further comprises a light transparent layer having a top perimeter and a bottom perimeter, wherein the top perimeter is sandwiched between the upper strip and the rear strip of material, and the bottom perimeter is sandwiched between the lower strip and the rear strip of material, wherein a portion of the light transparent layer extends across the channel and over the lighting element, thereby providing a protective cover over the lighting element.

5. The duty belt of claim 4, wherein the outermost point of the light transparent layer is positioned at or below the exterior surface of the exterior side of both the upper strip and the lower strip, thereby providing an unhindered exterior side accessible for attachment of the user's gear.

6. The duty belt of claim 5, wherein the lighting element is a linear light emitting diode strip.

7. The duty belt of claim 5, wherein the light transparent layer is at least partially manufactured of a mesh material.

8. The duty belt of claim 7, wherein the back side surface further comprises a layer of hook and loop material, thereby providing an attachment surface for the user's selected gear.

9. The duty belt of claim 7, further comprising a top perimeter cap and a lower perimeter cap, each of the top perimeter cap and the lower perimeter caps extends the length of the belt portion and is configured to clamp the layers at their respective perimeters in order to maintain structural integrity of the belt portion.

10. The duty belt of claim 1, wherein the light controller assembly further comprises a control unit for controlling the light intensity of the emitted light from the lighting element and timing of lighting flash sequence patterns.

11. A duty belt for providing visibility and awareness of a user wearing the belt, the belt comprising:

a belt portion configured to extend between a first end and a second end, the belt portion having a top perimeter, bottom perimeter, interior side and an exterior side having an exterior surface;

a buckle assembly for selectively connecting the first end and the second end of the belt;

a plurality of light emitting diodes operably positioned to emit light along a length of the exterior side of the belt portion between the first end and the second end;

a light controller assembly for selectively operating the light emitting diodes, the light controller assembly comprising:

a power supply for providing electric power; and a power switch;

wherein the exterior side of the belt portion comprises an upper planar strip of material extending a length of the top perimeter and a lower planar strip of material extending along a length of the bottom perimeter, the upper planar strip and the lower planar strip are positioned to form a channel which extends therebetween approximate a midpoint between the top perimeter and the lower perimeter along the length of the belt portion;

wherein the interior side of the belt portion comprises a rear strip of material extending between the top perimeter and the lower perimeter;

wherein the light emitting diodes are operably positioned between the upper planar strip and the lower planar strip within the channel, each having an outermost point, wherein the outermost points of the light emitting diodes are positioned at or below the exterior surface of the exterior side;

wherein the belt portion further comprises a light transparent layer having a top perimeter and a bottom perimeter, wherein the top perimeter is sandwiched between the upper strip and the rear strip of material and the bottom perimeter is sandwiched between the lower strip and the rear strip of material, wherein a portion of the light transparent layer extends across the channel and over the lighting element, thereby providing a protective cover over the lighting element.

12. The duty belt of claim 11, wherein the outermost point of the light transparent layer is positioned at or below the exterior surface of the exterior side of both the upper strip and the lower strip, thereby providing an unhindered exterior side accessible for attachment of the user's gear.

13. The duty belt of claim 12, wherein the light transparent layer is at least partially manufactured of a mesh material.

14. The duty belt of claim 13, wherein the back side surface further comprises a layer of hook and loop material, thereby providing an attachment surface for the user's selected gear.

15. The duty belt of claim 14, further comprising a top perimeter cap and a lower perimeter cap, each of the top perimeter cap and the lower perimeter caps extends the length of the belt portion and is configured to clamp the layers at their respective perimeters in order to maintain structural integrity of the belt portion.

* * * * *